US006487737B1

(12) United States Patent
Futagami

(10) Patent No.: US 6,487,737 B1
(45) Date of Patent: Dec. 3, 2002

(54) AIR PILLOW

(76) Inventor: Taneaki Futagami, 4-2-33-302, Nishikaniya, Minamiku, Hiroshimashi, Hiroshimaken (JP)

( * ) Notice: Subject to any disclaimer, the term of this patent is extended or adjusted under 35 U.S.C. 154(b) by 0 days.

(21) Appl. No.: 09/718,523

(22) Filed: Nov. 20, 2000

(51) Int. Cl.[7] ..... A47G 9/00
(52) U.S. Cl. ..... 5/644; 5/711
(58) Field of Search ..... 5/644, 711, 712, 5/655.3

(56) References Cited

U.S. PATENT DOCUMENTS 2,728,926 A * 1/1956 Embry ..... 5/644
3,251,075 A * 5/1966 Saltness et al. ..... 5/711
4,459,714 A * 7/1984 Lin ..... 5/711
D318,969 S * 8/1991 Byrn ..... D6/601
5,490,295 A * 2/1996 Boyd ..... 5/711
5,740,573 A * 4/1998 Boyd ..... 5/711
5,960,495 A * 10/1999 Hsu et al. ..... 5/711

FOREIGN PATENT DOCUMENTS

FR 1341526 A * 9/1963 ..... 5/712

* cited by examiner

*Primary Examiner*—Alexander Grosz

(57) ABSTRACT

An air pillow includes a first sheet; a second sheet; gussets; and a valve adapted to introduce or release air therethrough. The valve is joined to the first or second sheet through high-frequency heating. The first and second sheets are joined together at peripheral portions thereof through high-frequency heating. The gussets are disposed between and joined to the first and second sheets through high-frequency heating such that the gussets are located in a head rest area.

1 Claim, 6 Drawing Sheets

AIR PILLOW

BACKGROUND OF THE INVENTION

1. Field of the Invention

The present invention relates to an air pillow made of a flexible sheet, such as a vinyl chloride sheet, and adapted to support the neck and head of a user so as to help the user rest or sleep well in, for example, an automobile, an airplane, a train, or a like vehicle.

2. Description of the Related Art

As shown in FIG. 12, a conventional air pillow made of a flexible sheet includes appropriately formed upper and lower sheets. The two cutouts are joined together at their peripheral portions through high-frequency heating. This type of air pillow helps a user rest through support of his/her neck, but is not so formed to provide comfortable support for the back of his/her head. Particularly, when a user sitting in a vehicle recliner uses the air pillow while the recliner is reclined, the air pillow fails to comfortably support the back of his/her head. In recent years, in order to cope with this problem, an air pillow shown in FIG. 13 has been put on the market. The air pillow of FIG. 13 is in an uninflated state and includes appropriately cut upper and lower sheets, each having divided head rest portions. The two cutouts are joined together at their peripheral portions and along the divided head rest portions through high-frequency heating. When the air pillow is inflated, the head rest portions assume the form of pipes. However, the inflated head rest portions and their peripheral portions suffer deformation, such as longitudinal or lateral twist, curvature, or depression. That is, since the upper and lower sheets are joined together directly along the head rest portions through high-frequency heating, the inflation of the head rest portions involves the local occurrence of strong tension, with resultant unexpected deformation. Also, since a limited space is divided into the head rest portions, the inflated pipe-like head rest portions do not contain a sufficient amount of air to comfortably support the back of the head of a user. Thus, from functional and aesthetic points of view, the air pillow is not satisfactory.

SUMMARY OF THE INVENTION

An object of the present invention is to provide an air pillow which does not involve any deformation when inflated and which provides comfortable support for the back of the head of a user.

In order to solve uncertainty about the shape which an air pillow assumes when inflated, the present inventors have intensively studied how air pressure influences the structures of pneumatic products made of a flexible material, such as a vinyl chloride sheet, as observed when the products are inflated. On the basis of the thus-obtained findings, the present inventors have accomplished the invention.

The present invention provides an air pillow comprising: a first flexible sheet having a predetermined shape and size; a second flexible sheet having a predetermined shape and size substantially the same as those of the first sheet and joined to the first sheet along its circumferential edge; at least one gusset located in a head rest area of the pillow, the gusset being disposed between and joined to the first and second sheets; and a valve joined to the first or second sheet at a predetermined position and adapted to introduce or release air therethrough.

Preferably, the first and second sheets, the gusset, and the valve are each made of a resin; the second sheet is joined to the first sheet through high-frequency heating; the gusset is joined to the first and second sheets through high-frequency heating; and the valve joined to the first or second sheet through high-frequency heating.

Preferably, two or more gussets are provided in parallel in the head rest area such that the gussets extend in the widthwise direction of the pillow.

Preferably, each of the gussets has the shape of a rectangular tube extending in the widthwise direction of the pillow and has two joint wall portions joined to the first and second sheets, respectively, and two side wall portions extending between the two joint wall portions and defining a maximum distance between the first and second sheets.

Preferably, the maximum distance between the first and second sheets defined by the outermost gusset is smaller than that defined by a gusset adjacent to the outermost gusset.

Preferably, each of the gussets is formed by first and second gusset sheets, the first and second gusset sheets being joined to the first and second flexible sheets, respectively, and joined together along their lateral edges.

Through employment of the gusset(s), the air pillow of the present invention is free of any deformation, such as curvature, twist, or depression, which would otherwise occur at the head rest portion or the neck rest portion. Also, the air pillow can retain a sufficient amount of air in the head rest portion and in the neck rest portion so as to comfortably support the neck and the back of the head of a user. Thus, the invented air pillow exhibits excellent functionality and excellent appearance.

DESCRIPTION OF THE PREFERRED EMBODIMENT

An embodiment of the present invention will next be described in detail with reference to the drawings.

As shown in FIGS. 1 to 8, an air pillow according to the embodiment includes an upper sheet (first flexible sheet) 1, a lower sheet (second flexible sheet) 2, two gussets 3*a* and 3*b*, and a valve 4. The upper sheet 1, the lower sheet 2, the gussets 3*a* and 3*b*, and the valve 4 are each made of a flexible or elastic resin material such as vinyl chloride.

The upper sheet 1 and the lower sheet 2 have a U-like shape and are joined together along their circumferential edge, by means of high-frequency heating, to thereby form a pillow having a head rest area 5. In the present embodiment, the valve 4 is joined to the upper sheet 1 through high-frequency heating. The gussets 3*a* and 3*b* are provided in the head rest area 5. The number of gussets is not limited to two, and a single gusset or three or more gussets may be provided in the head rest area 5.

Figure 1:
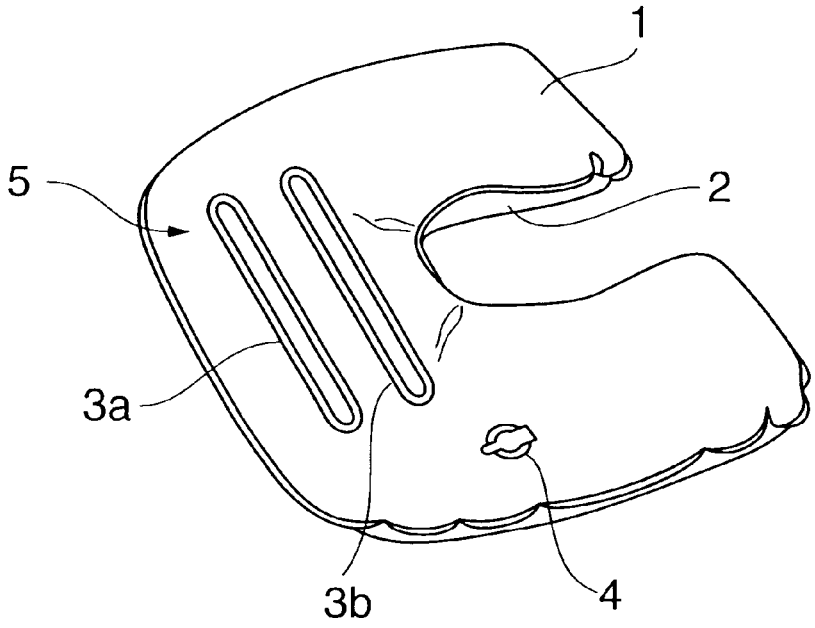
FIG. 1 is a perspective view of an air pillow according to an embodiment of the present invention.
Figure 2:
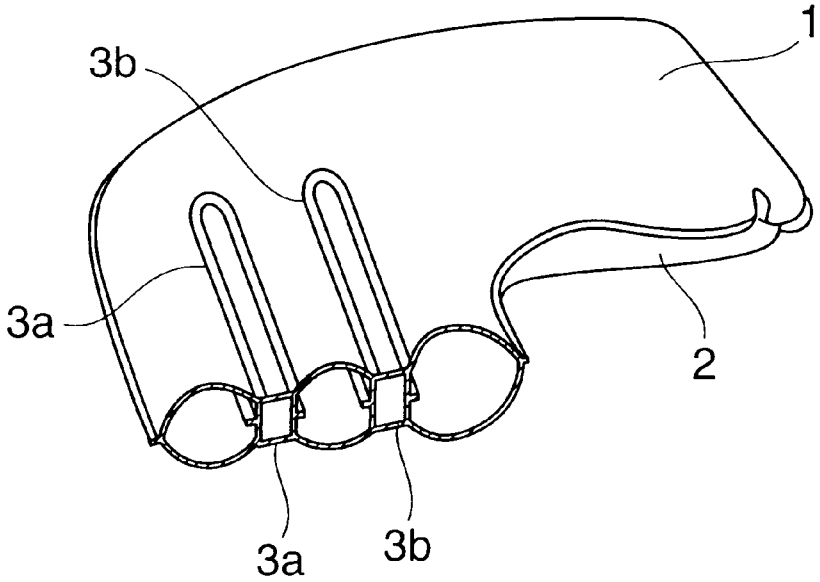
FIG. 2 is a sectional perspective view of the air pillow according to the embodiment.
Figure 3:
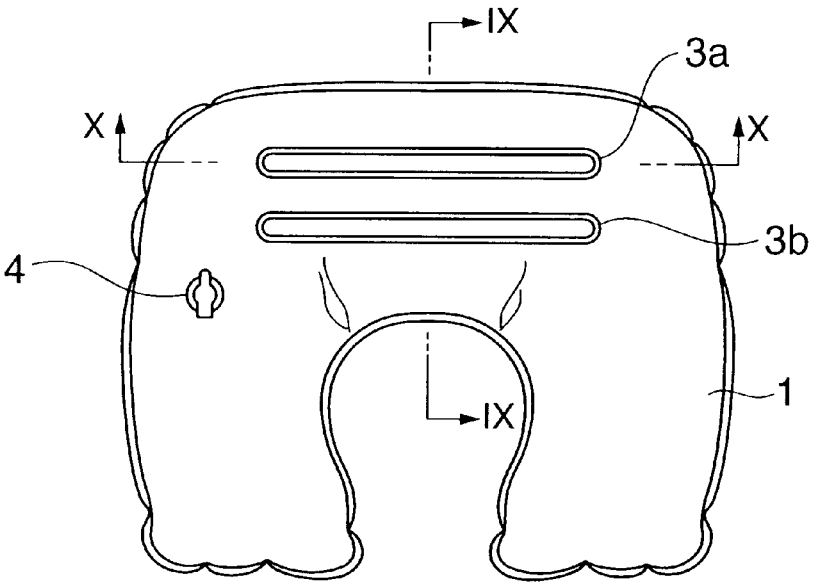
FIG. 3 is a front view of the air pillow according to the embodiment.
Figure 4:
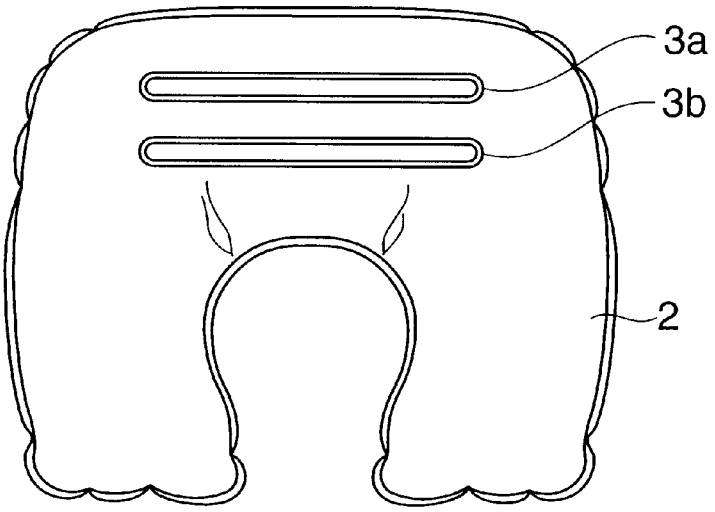
FIG. 4 is a rear view of the air pillow according to the embodiment.
Figure 5:
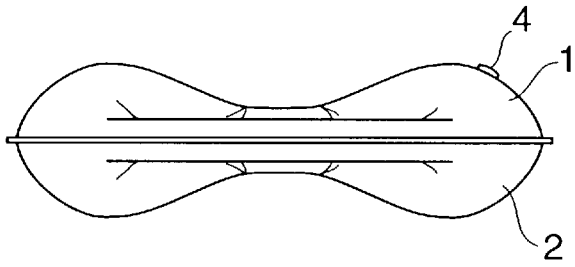
FIG. 5 is a top view of the air pillow according to the embodiment.
Figure 6:
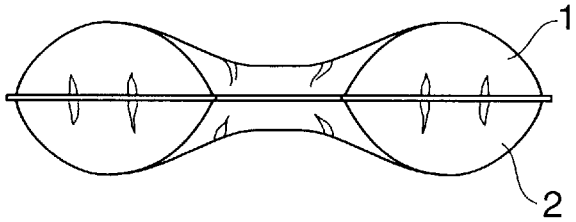
FIG. 6 is a bottom view of the air pillow according to the embodiment.
Figure 7:
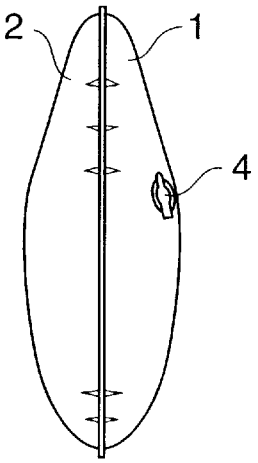
FIG. 7 is a left-hand side view of the air pillow according to the embodiment.
Figure 8:
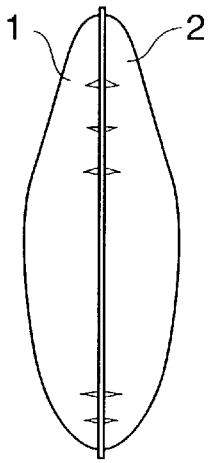
FIG. 8 is a right-hand side view of the air pillow according to the embodiment.
Figure 9:
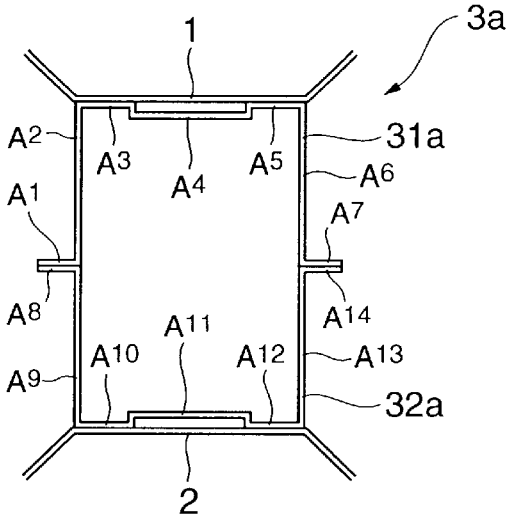
FIG. 9 is a partially enlarged sectional view of a gusset 3*a* taken along line IX—IX of FIG. 3.
Figure 10:
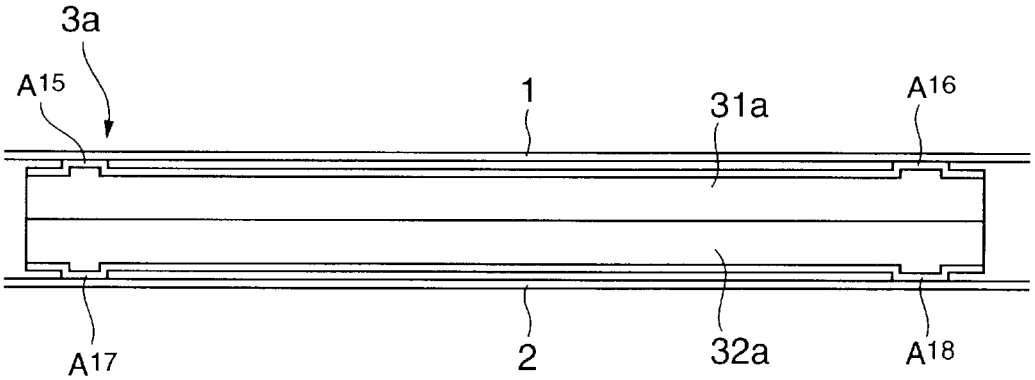
FIG. 10 is a partially enlarged sectional view of a gusset 3*a* taken along line X—X of FIG. 3.

As shown in FIGS. 2, 9, and 10, the gussets 3*a* and 3*b* are disposed between and joined to the upper sheet 1 and to the lower sheet 2 through high-frequency heating, such that the gussets 3*a* and 3*b* are located in the head rest area 5. Each of the gussets 3*a* and 3*b* has a shape of a rectangular tube and extends in the widthwise direction of the pillow. Each of the gussets 3*a* and 3*b* has upper and lower wall portions joined to the upper sheet 1 and to the lower sheet 2, respectively, and two side wall portions extending between the upper and lower wall portions and restricting the maximum distance between the upper sheet 1 and the lower sheet 2.

Next, the structure of the gussets 3*a* and 3*b* will be described in detail. Since the gussets 3*a* and 3*b* are structurally identical to each other, the structure of the gusset 3*a* and the joining of the gusset 3*a* to the upper and lower sheets 1 and 2 are described in detail. As shown in FIG. 9, the gusset 3*a* assumes a two-piece structure composed of two gusset elements (first and second gusset sheets) 31*a* and 32*a* each formed of vinyl chloride. The gusset element 31*a* includes portions $A^1$, $A^2$, $A^3$, $A^4$, $A^5$, $A^6$, and $A^7$, and the gusset element 32*a* includes portions $A^8$, $A^9$, $A^{10}$, $A^{11}$, $A^{12}$, $A^{13}$, and $A^{14}$. The portions $A^3$ and $A^5$ of the gusset element 31*a* are joined to the upper sheet 1 through high-frequency heating. Similarly, the portions $A^{10}$ and $A^{12}$ of the gusset element 32*a* are joined to the lower sheet 2 through high-frequency heating. Also, the portions $A^1$ and $A^8$ are joined together through high-frequency heating, while the portions $A^7$ and $A^{14}$ are joined together through high-frequency heating. As in the case of the gusset 3*a*, the gusset 3*b* is joined to the upper and lower sheets 1 and 2 through high-frequency heating. As specifically shown in FIG. 10, the opposite longitudinal ends of the gusset 3*a* are opened. Portions $Al^{15}$ and $A^{16}$ of the gusset element 31*a* are joined to the upper sheet 1 through high-frequency heating, and portions $A^{17}$ and $A^{18}$ of the gusset element 32*a* are joined to the lower sheet 2 through-high frequency heating. As is apparent from FIGS. 1, 9, and 10, the portions $A^3$, $A^5$, $A^{15}$, and $A^{16}$ of the gusset element 31*a* form a portion having an elongated oval shape through which the gusset element 31*a* is joined to the upper sheet 1. Similarly, the portions $A^{10}$, $A^{12}$, $A^{17}$, and $A^{18}$ of the gusset element 32*a* form a portion having an elongated oval shape through which the gusset element 32*a* is joined to the lower sheet 2. The opposite longitudinal ends of the gusset 3*a* may be closed. In this case, communications holes are formed in the side walls (portions $A^2$, $A^6$, $A^9$ and $A^{13}$) of the gusset 3*a* in order to establish communication between the interior of the gusset 3*a* and the exterior of the gusset 3

Figure 11:
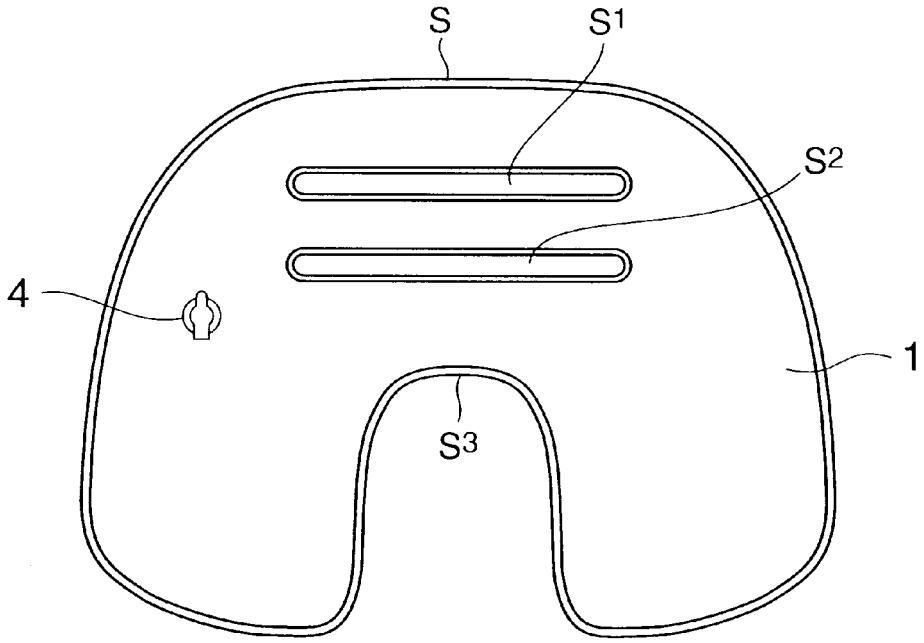
FIG. 11 is a front view of the uninflated air pillow according to the embodiment.
Figure 12:
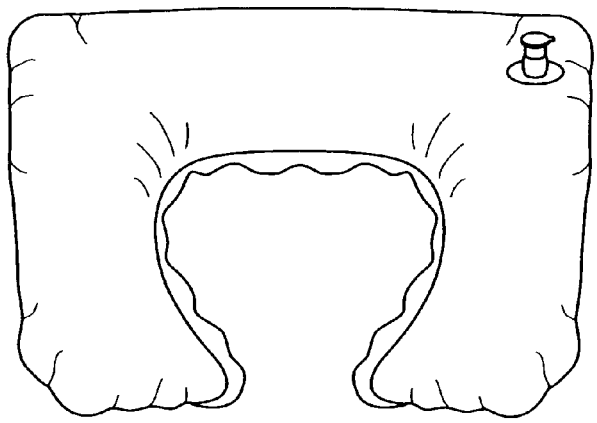
FIG.12 (PRIOR ART)
FIG. 12 is a front view of a conventional air pillow.
Figure 13:
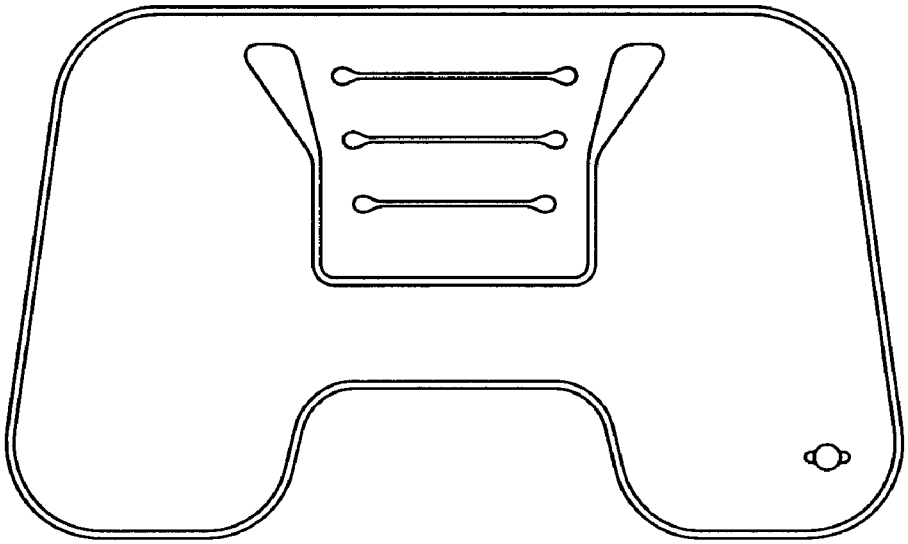
FIG. 13 (PRIOR ART)
FIG. 13 is a front view of another conventional air pillow.

The size of the air pillow will next be described with reference to FIG. 11, which shows the uninflated air pillow. The uninflated air pillow has a maximum longitudinal length of about 31 cm and a maximum lateral length (i.e., width) of about 41 cm. The distance between point S and point $S^1$ is 5.5 cm; the distance between point $S^1$ and point $S^2$ is 4 cm; and the distance between point S2 and point S3 is 7 cm. The gussets 3*a* and 3*b* each have a longitudinal length (i.e., length in the width direction of the pillow) of 18 cm. The height of the gusset 3*a*; i.e., the total length of $A^2$ and $A^9$ of FIG. 9 is about 2 cm to 2.5 cm. Similarly, the height of the gusset 3*b* is about 3 cm to 3.5 cm. The heights of the gussets 3*a* and 3*b* each define the maximum distance between the upper sheet 1 and the lower sheet 2 in the head rest area Notably, an air pillow with the gussets 3*a* and 3*b* having the same height of 2 cm was manufactured by way of experiment. When the thus-manufactured air pillow was inflated as a trial, opposite end portions of the gusset 3*b* could not endure the force of inflation and were torn off. Further, an air pillow with the gusset 3*b* having a height of about 3 cm to 3.5 cm as well as with the gusset 3*a* having a height of 2 cm was manufactured by way of experiment. The thus-modified air pillow was subjected repeatedly to an inflation test and proved to be free of any tear. The test revealed that as a result of the height of the gusset 3*b* being increased by only about 1 cm, the force of inflation could be controlled appropriately.

Through impartment of a height of about 3 cm to 3.5 cm to the gusset 3*b*, the gusset 3*b* as well as the gusset 3*a* can be made of conventional vinyl chloride. Through formation of the gusset 3*b* as well as the gusset 3*a* from a highly flexible vinyl chloride sheet, the gusset 3*b* was reliably protected from tear.

Each of the gussets 3*a* and 3*b* may assume a single-piece structure. Specifically, the gusset 3*a* (3*b*) made of a single sheet is joined to the upper and lower sheets 1 and 2 through high-frequency heating. Preferably, in order to reliably prevent tearing, the gussets 3*a* and 3*b* each assume a two-piece structure as described above.

In order to help a user rest or sleep well, the design of the air pillow employs gentle curves so as to induce peace of mind and comfort when the air pillow is inflated. In the case of many conventional air pillows, an edge portion corresponding to that including point s in FIG. 11 assumes a straight profile. When such a conventional air pillow is inflated, a depression is formed on the edge portion. In order to avoid such a problem, in the present invention, the edge portion including point s assumes the form of a gentle curve.

The air pillow of the present invention is made of a flexible sheet, such as a vinyl chloride sheet. In order to avoid generation of dioxin, the air pillow may be made of an ecological-recycle type of flexible sheet. Examples of such an ecological flexible sheet include a biodegradable plastic sheet made from a plant, such as corn.

Obviously, numerous modifications and variations of the present invention are possible in light of the above teachings. It is therefore to be understood that within the scope of the appended claims, the present invention may be practiced otherwise than as specifically described herein.

What is claimed is:

1. A generally U-shaped head supporting air pillow having two lobes, defining a well portion therebetween, the lobes extending from a head rest portion, the pillow comprising:

a first flexible sheet having a predetermined shape and size;

a second flexible sheet having a predetermined shape and size substantially the same as those of the first sheet and joined to the first sheet along its circumferential edge;

a plurality of gussets located in the head rest portion of the pillow, the gussets being disposed between and joined to the first and second sheets, the guests extending in the width direction of the pillow; and a valve joined to the first or second sheet at a predetermined position and adapted to introduce or release air therethrough, wherein each of the gussets has the shape of a rectangular tube extending in the widthwise direction of the pillow and has two joint wall portions joined to the first and second sheets, respectively, and two side wall portions extending between the two joint wall portions and defining a maximum distance between the first and second sheets; and wherein each of the gussets is formed by first and second gusset sheets the first and second gusset sheets being joined to the first and second flexible sheets respectively, and joined together along their lateral edges.

* * * * *